United States Patent [19]

Kobayashi et al.

[11] Patent Number: 4,733,029

[45] Date of Patent: Mar. 22, 1988

[54] OPERATING HANDLE LOCKING DEVICE FOR CIRCUIT INTERRUPTER

[75] Inventors: Yoshiaki Kobayashi; Yutaka Nakayama, both of Fukuyama, Japan

[73] Assignee: Mitsubishi Denki Kabushiki Kaisha, Japan

[21] Appl. No.: 865,015

[22] Filed: May 20, 1986

[30] Foreign Application Priority Data

May 23, 1985 [JP] Japan ..... 60-111031
May 23, 1985 [JP] Japan ..... 60-76611[U]

[51] Int. Cl.[4] ..... H01H 9/28

[52] U.S. Cl. ..... 200/43.15; 200/43.19; 200/318

[58] Field of Search ..... 200/43.11, 43.12, 43.14, 200/43.15, 43.22, 43.16, 43.18, 43.19, 43.21, 318, 328

[56] References Cited

U.S. PATENT DOCUMENTS

| | | | |
|---|---|---|---|
| 1,383,781 | 7/1921 | Ball | 200/43.14 |
| 1,983,902 | 12/1934 | Hanny | 200/43.14 |
| 2,832,857 | 4/1958 | Landmeier | 200/43.19 |
| 2,946,864 | 7/1960 | Marien | 200/43.14 X |
| 2,978,613 | 4/1961 | Hein | 200/43.11 |
| 3,327,075 | 6/1967 | Phillipson | 200/43.15 |
| 3,670,228 | 7/1972 | Adamson | 200/43.15 |
| 4,160,137 | 7/1979 | Clement et al. | 200/43.15 |
| 4,260,861 | 4/1981 | DiMarco | 200/43.15 |

FOREIGN PATENT DOCUMENTS

| | | | |
|---|---|---|---|
| 677653 | 1/1964 | Canada | 200/43.14 |

*Primary Examiner*—Henry J. Recla
*Assistant Examiner*—Ernest G. Cusick
*Attorney, Agent, or Firm*—Leydig, Voit & Mayer

[57] ABSTRACT

An operating handle locking device for use with an electrical switchgear such as a circuit interrupter comprises a locking plate for blocking the movement of the operating handle between the ON position and the OFF position, and a support plate secured to the circuit interrupter for supporting the lock plate, the locking plate being locked in the operating handle locking position relative to the support plate by a locking member. The switchgear may have a trip button for tripping the switchgear from the exterior, and the locking plate may have a cover portion for covering the trip button when the locking plate is in an operating handle locking position. A cover portion may also be provided in the locking plate for covering the reset button of the circuit interrupter when in the operating handle locking position.

2 Claims, 7 Drawing Figures

OPERATING HANDLE LOCKING DEVICE FOR CIRCUIT INTERRUPTER

BACKGROUND OF THE INVENTION

This invention relates to an operating handle locking device for preventing the operation of an operating handle of an electric switchgear such as a circuit interrupter.

An operating handle locking device of the conventional design is arranged as illustrated in FIGS. 1 to 3 in which the operating handle locking device is shown as being applied to a circuit interrupter. FIG. 1 is a side view of a circuit interrupter partly cut away, FIG. 2 is a perspective view of the circuit interrupter shown in FIG. 1, and FIG. 3 is an exploded perspective view of an operating handle and a handle cap of the conventional locking device. In FIGS. 1 to 3, a cover or a second housing 2 made of a molded electrically insulating material is mounted on a base or a first housing 1 made of a molded electrically insulating material. The cover has an aperture 2*a* and an inner wall 2*b* of the aperture 2*a*. An operating handle 3 made of a molded electrically insulating material and having a lever portion 3*a* extends through the aperture 2*a* of the cover 2 so that the operating handle 3 can be operated from the exterior of the circuit interrupter. The lever portion 3*a* of the operating handle 3 also has formed therethrough a through hole 3*b*. The operating handle 3 is placed on a handle arm 4 of an unillustrated operating mechanism of the circuit interrupter for the movement therewith, and a handle cap 5 made of a bent metallic sheet material is placed over the operating handle 3. One end of the handle cap 5 is formed into a substantially U-shaped engaging portion 5*a* for engaging the lever portion 3*a* of the operating handle 3 and having a pair of through holes 5*b* in the parallel portions of the engaging portion 5*a*. The other end of the handle cap 5 is formed into a substantially L-shaped blocking portion 5*c*. A locking member 6 such as a padlock is inserted through the through hole 3*b* of the operating handle 3 and the through holes 5*b* of the handle cap 5 and locks the handle cap 5 in engagement with the operating handle 3 so that it can not be disengaged therefrom. A trip button 7 for mechanically tripping the circuit interrupter from the exterior is provided for testing whether the alarm switch properly operates upon tripping, and whether the operating handle 3 can properly move from the trip position to the reset position when an externally operating lever (not shown) for externally operating the operating handle 3 is mounted on the front face of the circuit interrupter.

When the operating handle 3 is moved to the ON position (to the right) in FIG. 1 before placing the handle cap 5 onto the operating handle 3, the handle arm 4 is accordingly moved to move a pair of electrical contacts (not shown) of the circuit interrupter to the ON position through an operating mechanism (not shown). When the operating handle 3 is moved to the OFF position (to the left) in FIG. 1, the handle arm 4 is accordingly moved to move the pair of electrical contacts (not shown) to the OFF position through the operating mechanism (not shown).

However, there are circumstances in which such ON and OFF operations of the operating handle 3 should be prevented. For example, when electrical work such as inspection, repair and maintenance is to be done on the load side, the circuit interrupter should be held in the OFF position in order to protect the personnel doing the work against electrical shocks or the like. Alternately, the circuit interrupter should be held in the ON position where an electronic computer is in use which usually requires a continuing power supply. In such cases, in accordance with the ON or OFF position in which the operating handle 3 is to be held, the handle cap 5 is placed on the operating handle 3 with its engaging portion placed on either the left or right in FIG. 1. Then, the locking member 6 is inserted into the through hole 3*b* of the operating handle 3 and the through hole 5*b* of the handle cap 5 which are aligned with each other to lock the handle 3 and the handle cap 5.

FIGS. 1 and 2 illustrate the circuit interrupter held in the OFF position. In this state, the operation of the operating handle 3 is prevented by the blocking portion 5*c* of the handle cap 5 which abuts against the inner wall 2*b* of the cover 2. Since the operating handle 3 cannot be moved to the ON position (to the right in the figure) in the state shown in FIGS. 1 and 2, the electrical contact of the circuit interrupter cannot be closed. When the operating handle 3 is similarly locked as described above with the operating handle 3 held in the ON position (right in the figure), the electrical contact is prevented from moving into the OFF position.

However, conventional operating handle locking devices for electrical switchgear such as a circuit interrupter have been constructed according to special specifications since customer orders are few and far between, so that a standard type circuit interrupter must usually be specially rebuilt to accomodate an operating handle locking device. More specifically, the rebuilding has usually been achieved by removing the cover 2 from the base 1 and disengaging the operating handle 3 from the handle arm 4, and then forming the through hole 3*b* in the lever portion 3*a* of the operating handle 3. Such rebuilding is therefore, time-consuming and makes the circuit interrupter more expensive, and this also allows dust and foreign matter to enter the circuit interrupter when the cover 2 is removed from the base 1, decreasing reliability. If the through hole 3*b* is formed in each operating handle of a standard circuit interrupter in the factory in order to solve the above problem, the molding die and the molding operation become complicated, and the cost of a standard circuit interrupter which does not use an operating handle locking device becoming increased. Further, if the trip button is erroneously depressed at the time of locking the operating handle in the ON position, the internal mechanism is brought into the tripped state, so that the meaning of locking the interrupter in the ON position is lost.

SUMMARY OF THE INVENTION

Accordingly, an object of the present invention is to provide an operating handle locking device for an electrical switchgear in which the above problems of the conventional locking device are eliminated.

Another object of the present invention is to provide an operating handle locking device for an electrical switchgear in which the operating handle of the switchgear can be held in the ON or OFF position without the need for any work on the lever portion of the operating handle.

Still another object of the present invention is to provide an operating handle locking device for an electrical switchgear such as a circuit interrupter in which the operating handle of the circuit interrupter can be held in the ON or OFF position without the need for any work on the lever portion of the operating handle and in which the trip button cannot be operated from outside of the circuit interrupter when the operating handle is held in the ON position.

The operating handle locking device for use with a switchgear constructed in accordance with the present invention comprises a locking plate for blocking the movement of the operating handle between the ON position and the OFF position, and a support plate secured to the circuit interrupter for supporting the lock plate, the locking plate being locked in the operating handle locking position relative to the support plate by a locking member. A cover portion may be provided in the locking plate for covering the reset button when in the operating handle locking position.

According to the present invention, when the locking plate is maintained in the operating handle locking position, the locking plate prevents the movement of the operating handle between the ON and OFF positions. Erroneous operation of the reset button may also be prevented by the cover portion of the locking plate.

BRIEF DESCRIPTION OF THE DRAWINGS

The present invention will become more readily apparent from the following detailed description of the preferred embodiments thereof taken in conjunction with the accompanying drawings, in which.

DESCRIPTION OF THE PREFERRED EMBODIMENTS

Figure 1:
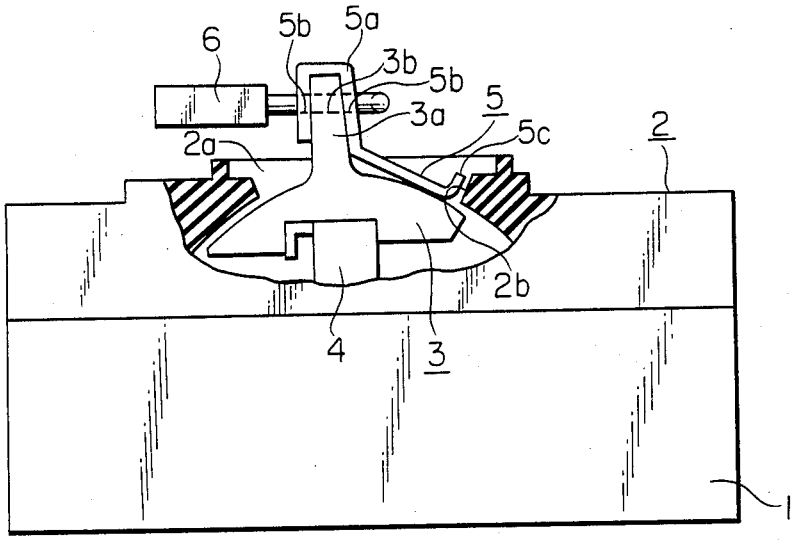
FIG. 1 PRIOR ART
FIG. 1 is a side view partly cut away of the circuit interrupter having a conventional operating handle locking device.
Figure 2:
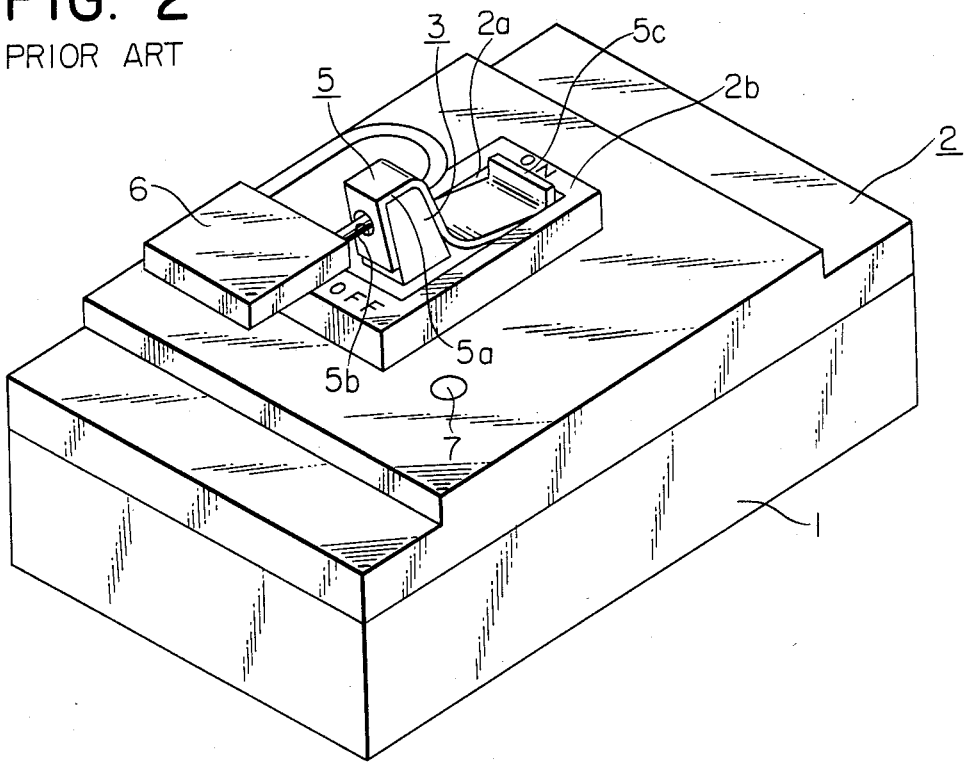
FIG. 2 PRIOR ART
FIG. 2 is a perspective view of the operating handle locking device shown in FIG. 1.
Figure 3:
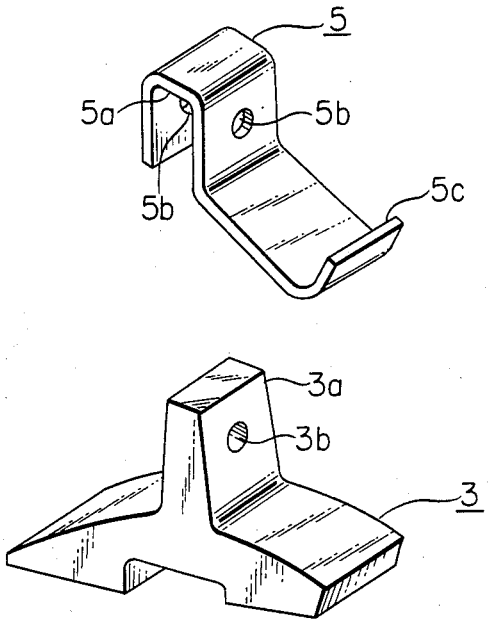
FIG. 3 PRIOR ART
FIG. 3 is an exploded perspective view of the operating handle and the handle cap of the operating handle locking device of the circuit interrupter shown in FIGS. 1 and 2.
Figure 4:
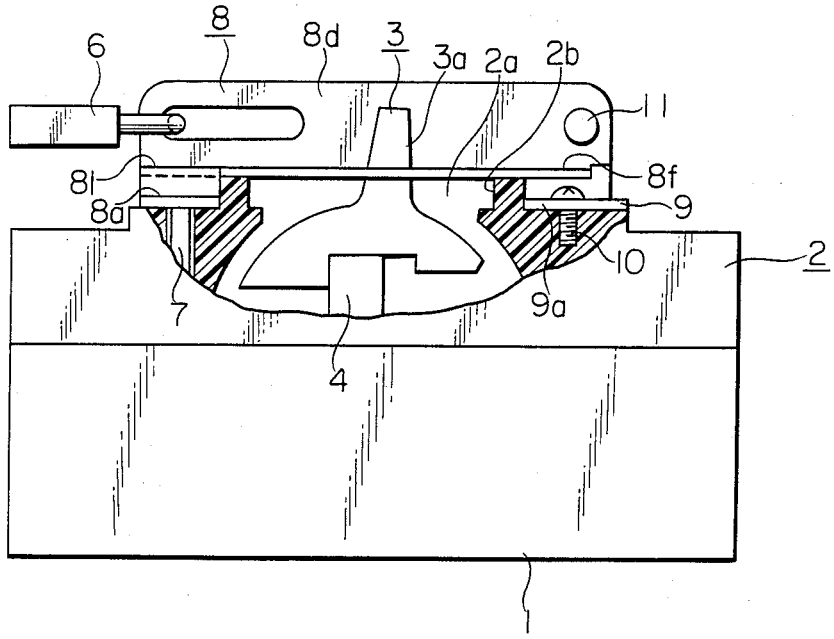
FIG. 4 is a side view partly cut away of the circuit interrupter in which one embodiment of the present invention is applied.
Figure 5:
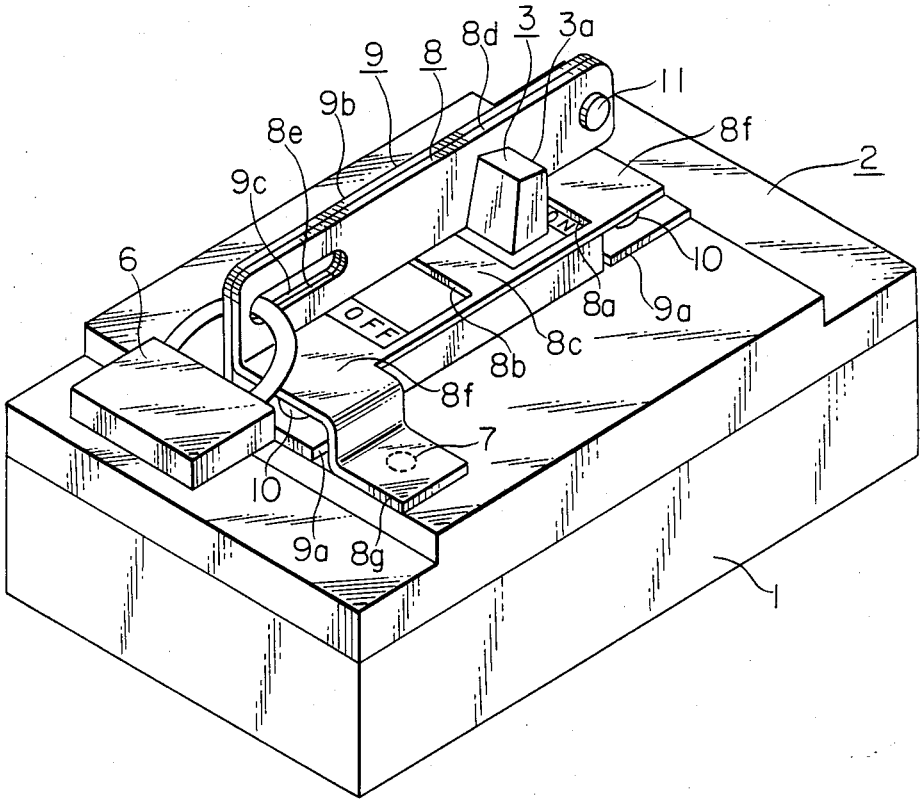
FIG. 5 is a perspective view of the device shown in FIG. 4.
Figure 6:
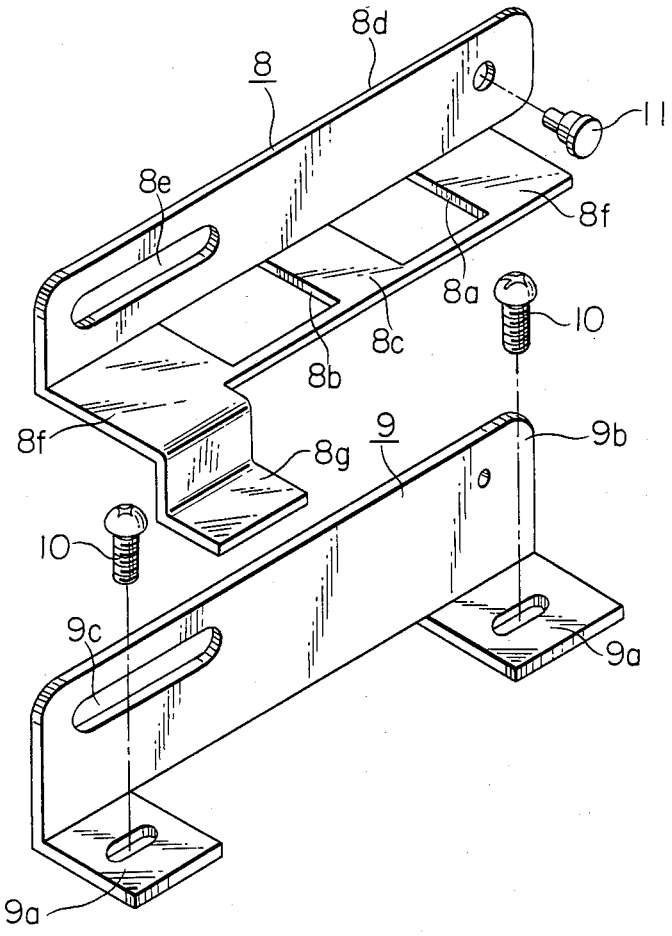
FIG. 6 is an exploded perspective view of the locking plate and the support plate of the embodiment shown in FIG. 5.

Referring now to FIGS. 4 to 6 in which the same components shown in FIGS. 1 to 3 are designated by the same reference numerals, a locking plate 8 comprises a first aperture 8*a* for receiving therein the lever portion 3*a* of the operating handle 3 when it is in the ON position, and a second aperture 8*b* for receiving therein the operating handle 3 when it is in the OFF position. The locking plate 8 further comprises a blocking portion 8*c* disposed between the first and second apertures 8*a* and 8*b* for blocking the movement of the operating handle 3 from the position in one of the apertures to that in the other of the apertures. A support plate 9 for supporting the lock plate 8 comprises securing portions 9*a* secured to the cover 2 of the circuit interrupter by means of securing members 10 such as screws and rivets, and a rising portion 9*b* rising from the cover 2. The locking plate 8 has a rising portion 8*d* opposing the rising portion 9*b* of the support plate 9, and one end of the rising portion 8*d* is pivoted to the rising portion 9*b* of the support plate 9 by means of the pivot pin 11. The rising portions 8*d* and 9*b* facing the locking plate 8 and the support plate 9 have formed therein holes 8*e* and 9*c* which can be brought into alignment to allow the locking member 6 to extend therethrough. The locking plate 8 is also provided with a cover portion 8*f* for covering the securing member 10 and a cover portion 8*g* for covering the trip button 7 when the locking plate 8 is in the operating handle locking position illustrated in FIG. 4.

When it is desired to lock the operating handle 3 in the ON position as illustrated in FIG. 5, the lever portion 3*a* of the operating handle 3 is inserted into the first aperture 8*a* of the locking plate 8 and the locking member 6 is inserted through the holes 8*e* and 9*c*. Thus, the operating handle 3 is prevented from being moved into the OFF position by the blocking portion 8*c* of the locking plate 8. Also, since the locking plate 8 is locked against the support plate 9 by the locking member 6, it cannot be moved from the operating handle locking position illustrated in the figure, whereby the operating handle 3 is securely locked in the ON position. At this time, the cover portion 8*g* of the locking plate 8 covers the trip button 7, so that the trip button 7 will never be operated mistakenly, and since the cover portion 8*f* covers the securing member 10, the securing member 10 will never be erroneously removed. When it is desired to lock the operating handle 3 in the OFF position, the lever portion 3*a* is inserted into the second aperture 8*b* of the locking plate 8.

Figure 7:
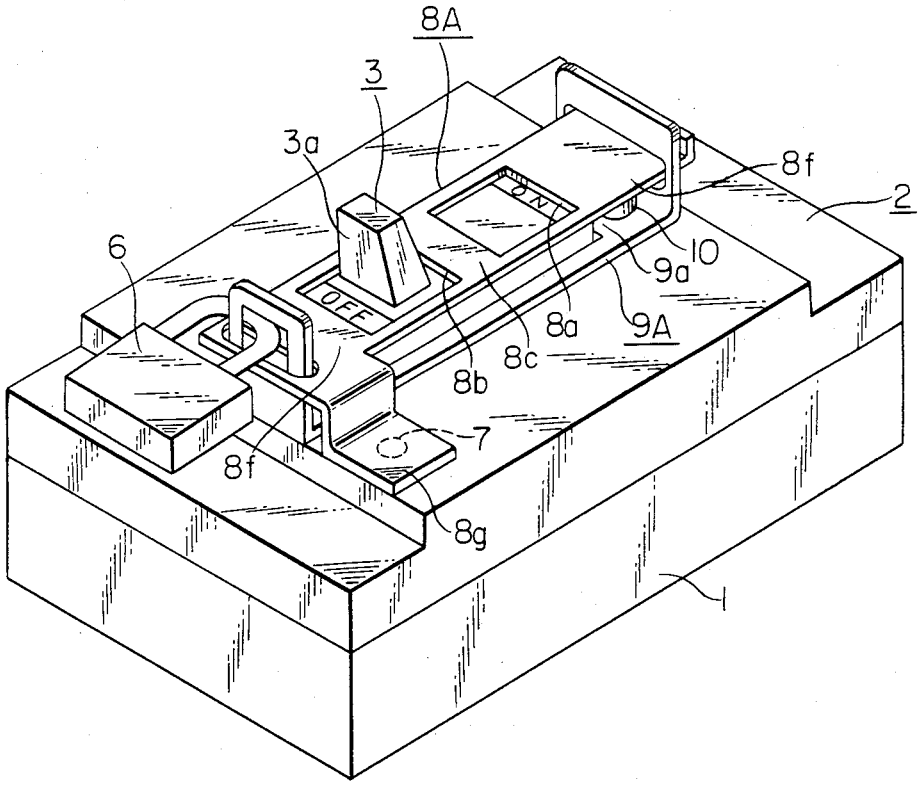
FIG. 7 is a perspective view of the circuit interrupter in which another embodiment of the present invention is applied.

FIG. 7, in which the same or corresponding components shown in FIGS. 4 to 6 are designated by the same reference numerals, illustrates another embodiment of the present invention. In this embodiment, a locking plate 8A and a support plate 9A are different from those of the previous embodiment only in that the locking plate 8A and the support plate 9A of this embodiment engage with each other as shown in FIG. 7 rather than pivotally supporting the locking plate 8A by the support plate 9A. In other respects they are the same. It is apparent without a detailed explanation that, in this embodiment also, locking of the operating handle 3 and the prevention of the operation of the reset button 7 in the operating handle locking position can be achieved.

Further, while the apertures 8*a* and 8*b* of the above embodiments have an entirely closed periphery, one side portion thereof as viewed in FIGS. 5 and 7 may be opened.

As has been described, according to the present invention, since the operating handle can be locked in the ON or OFF position by the locking plate, there is no need for the operating handle to be modified in any manner, eliminating the time and cost for such modification, and since it is not necessary to disassemble the circuit interrupter for such work, reliability of the circuit interrupter is not decreased because dust and foreign matter cannot enter into the circuit interrupter.

Further, since the locking plate may comprise a trip button cover, erroneous operation of the trip button can be prevented when the locking plate is in the operating handle locking position.

What is claimed is:

1. An operating handle locking device for holding an operating handle of an electrical switchgear in an ON position or in an OFF position, said operating handle locking device comprising:

a locking plate having a first aperture for receiving therein the operating handle when it is in the ON position, a second aperture for receiving therein the operating handle when it is in the OFF position, and a blocking portion disposed between said first and second apertures for blocking the movement of the operating handle between said positions;

a support plate secured to said switchgear for movably supporting said locking plate in an operating handle non-locking position in which the operating handle is disengaged from said first and second apertures;

a locking means for locking said locking plate in an operating handle locking position relative to said support plate; and a trip button for externally tripping the switchgear, said locking plate further having a cover portion for covering said trip button when said locking plate is in the locking position.

2. An operating handle locking device for holding an operating handle of an electrical switchgear in an ON position or in an OFF position, siad operating handle locking device comprising:

a locking plate having a first aperture for receiving therein the operating handle when it is in the ON position, a second aperture for receiving therein the operating handle when it is in the OFF position, and a blocking portion disposed between said first and second apertures for blocking the movement of the operating handle between said positions;

a support plate secured to said switchgear for movably supporting said locking plate in an operating handle non-locking position in which the operating handle is disengaged from said first and second apertures;

a locking means for locking said locking plate in an operating handle locking position relative to said support plate; and securing members for securing said support plate to said switchgear, said locking plate further having a cover portion for covering said securing members when said locking plate is in the locking position.

* * * * *